US006920710B2

(12) United States Patent
Murphy

(10) Patent No.: US 6,920,710 B2
(45) Date of Patent: Jul. 26, 2005

(54) ARTICULATED DISPLAY

(75) Inventor: Terry J. Murphy, Scappoose, OR (US)

(73) Assignee: Rapid Displays, Inc., Chicago, IL (US)

( * ) Notice: Subject to any disclaimer, the term of this patent is extended or adjusted under 35 U.S.C. 154(b) by 163 days.

(21) Appl. No.: 10/171,869

(22) Filed: Jun. 14, 2002

(65) Prior Publication Data

US 2003/0230014 A1 Dec. 18, 2003

(51) Int. Cl.[7] ..... G09F 19/08
(52) U.S. Cl. ..... 40/421; 40/616.16; 446/330
(58) Field of Search ..... 40/421, 606.15, 40/606.16, 615; 446/330

(56) References Cited

U.S. PATENT DOCUMENTS

| | | | | |
|---|---|---|---|---|
| 2,027,536 A | | 1/1936 | Joralemon et al. | |
| 2,142,549 A | | 1/1939 | Anderson | |
| D131,540 S | | 3/1942 | Phillips | |
| 2,704,910 A | | 3/1955 | Paige | |
| 2,757,468 A | | 8/1956 | Cain | |
| 3,108,696 A | * | 10/1963 | Winner | 40/124.191 |
| 3,181,261 A | * | 5/1965 | Swartz | 40/421 |
| 4,100,690 A | | 7/1978 | O'Neill | |
| 4,159,765 A | | 7/1979 | Roccaforte | |
| 4,348,448 A | | 9/1982 | Cornell | |
| 4,586,279 A | | 5/1986 | Hopkins | |
| 5,293,705 A | | 3/1994 | Wood | |
| 5,470,301 A | | 11/1995 | Brunt, II | |
| 5,853,511 A | | 12/1998 | Fairbanks | |
| 5,992,071 A | | 11/1999 | Dahlquist | |
| D434,081 S | | 11/2000 | Gruber | |

FOREIGN PATENT DOCUMENTS

FR 2700707 A1 * 7/1994 ..... A63H/3/46

* cited by examiner

*Primary Examiner*—Gary C. Hoge
(74) *Attorney, Agent, or Firm*—Piper Rudnick LLP

(57) ABSTRACT

An articulated display has at least two substrates including a first substrate attached to a second substrate. The first substrate has joints opposing and corresponding to joints on the second substrate. At least one plastically bendable, generally flat, reinforcing plate is disposed to cross at least one of the joints and is disposed between the first and second substrates. The reinforcing plate is used for bending the substrates at the joints with the reinforcing plate(s) into a bent configuration and holding the bent configuration.

54 Claims, 5 Drawing Sheets

ARTICULATED DISPLAY

TECHNICAL FIELD OF THE INVENTION

The present invention relates generally to signs and displays, and more particularly to flat, articulated displays with plastically bendable joints for posing and supporting the display.

BACKGROUND OF THE INVENTION

Temporary displays that are commonly used in e.g. retail settings stand upright and are typically made of rigid boards, such as cardboard or foam board. These known displays are signs for providing instructions or information to a reader, for advertising products or for holding and displaying products such as clothes. It is advantageous for such a display to exhibit three dimensionality, for example to attract the attention of a viewer. These displays, however, frequently have structures that cannot be collapsed without damaging the display once the display is assembled. In that case, the display is stored or transported in its assembled state, which is cumbersome and increases the likelihood that the display will be damaged during transport and/or storage, making the display unusable. This is especially true when the display is so complex it must be assembled or setup by the manufacturer. Shipping the display already setup adds great expense. In addition, the assembled display may then be damaged while transporting it to a store and before it is ever used.

Another problem with known displays is that the conventional cardboard or paper display provides very limited uses because it typically provides one assembled configuration and cannot be plastically bent into a variety of poses like a mannequin.

Furthermore, one type of typical board display that stands upright has a relatively complex and expensive structure that uses a separate back support brace or tab to create a three-point stance for a flat board to stand upright, similar to how some known desk picture frames stand upright. Other display structures, such as that disclosed by U.S. Pat. No. 5,992,071 issued to Dahlquist, require relatively complex structures such as an X-shape to create a four or five point stance to support the display in an upright position.

SUMMARY OF THE INVENTION

The problems mentioned above are solved by the invention, which in a first aspect provides an articulated display that has at least two substrates including a first substrate attached to a second substrate. The first substrate has joints opposing and corresponding to joints on the second substrate. At least one plastically bendable, generally flat, reinforcing plate is disposed to cross at least one of the joints and is disposed between the first and second substrates. The reinforcing plate is used for plastically bending the substrates at the joint(s) into a bent configuration and holding that configuration, and for bending the substrates back to a generally flat configuration and holding the flat configuration. This can be done repeatedly.

In another aspect of the present invention, the articulated display includes a representation of an articulated object, and includes at least one substrate that has joints disposed at positions corresponding to and representing joints of the object. The depicted object can be any image including scenes, designs, abstracts, and other inanimate objects, but is also adaptable for depicting objects such as a human, animal, other being or machine that moves. The reinforcing plate is disposed across at least one joint for holding the substrate in the bent configuration for representing a pose by the object. The substrate may have margins or outer peripheries formed as a silhouette of the object in order to better visually suggest the object.

Also included in the invention is a bendable display that has at least one plastically bendable, generally flat, reinforcing plate. A first and second substrate sandwich the plate between them, and the plate is adhered to at least one of the substrates, and preferably both. The display can then be plastically bent anywhere the plate(s) abut a substrate. This aspect of the invention includes a configuration with a single continuous plate that abuts substantially the entire area of the substrates.

In a further aspect of the present invention, a method of constructing an articulated display includes the steps of providing linear indents on a first and a second substrate to form bendable joints for bending the substrates, and placing flat, plastically bendable reinforcing plates across the joints on the first substrate. The method then includes placing adhesive on at least the first substrate and the exposed surface of the reinforcing plates. A second substrate is then placed on the first substrate and the exposed surface of the reinforcing plates. Information or a picture is printed on the first or the second substrate, or both, defining at least one printed substrate. Finally, at least the exterior surface of the printed substrate is laminated.

Another method for constructing a display would be to laminate full sheets of two substrates with a plastically bendable plate or substrate in between. This allows for a silhouette of figures or forms that will be depicted to be die cut "cookie-cutter" style from a single large sheet of the 3-layer structure or lamination so that the bendable plate is present throughout the entire area of the figure or form. This provides additional strength and support. It also allows for "nesting" the forms for better sheet yield while eliminating the hand labor of placing the bendable substrate only at specific areas of a form.

Still another aspect of the present invention is a method of displaying an articulated display. This method includes the step of folding the display along joints of at least one substrate having generally flat, plastically bendable reinforcing plates that cross the joints and hold the substrate in a bent configuration for use.

BRIEF DESCRIPTION OF THE DRAWINGS

The above mentioned and other features of the present invention and the manner of obtaining them will be apparent, and the invention itself will be best understood by reference to the following description of the preferred embodiment of the invention in conjunction with the following drawings, in which.

DETAILED DESCRIPTION OF ILLUSTRATED EMBODIMENT

Figure 1:
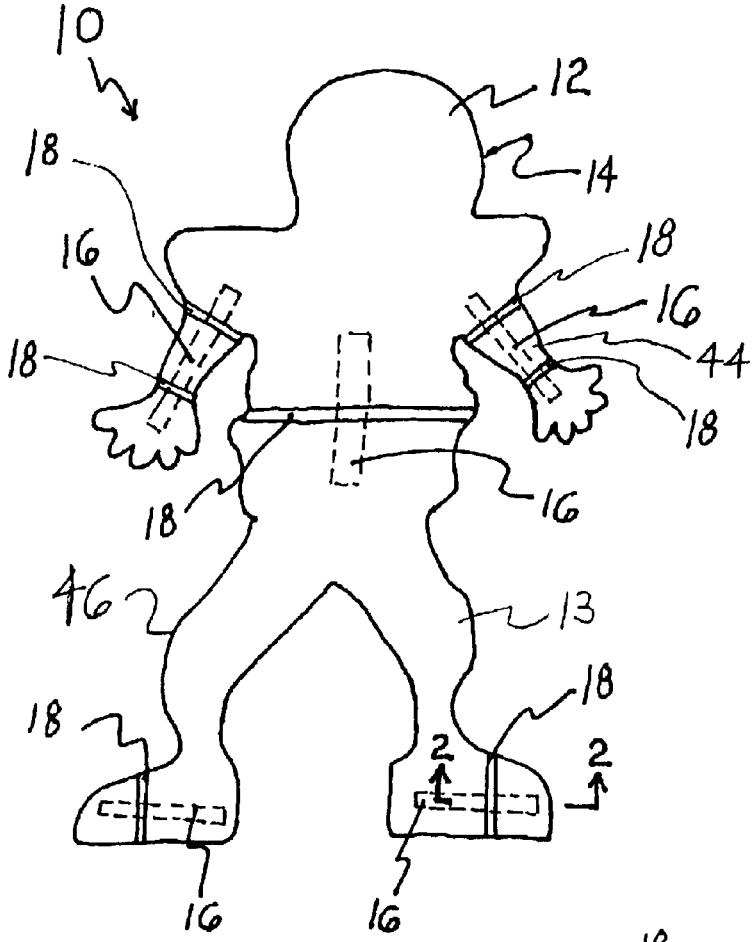
FIG. 1 is a front elevation of the present display according to the present invention.
Figure 2:
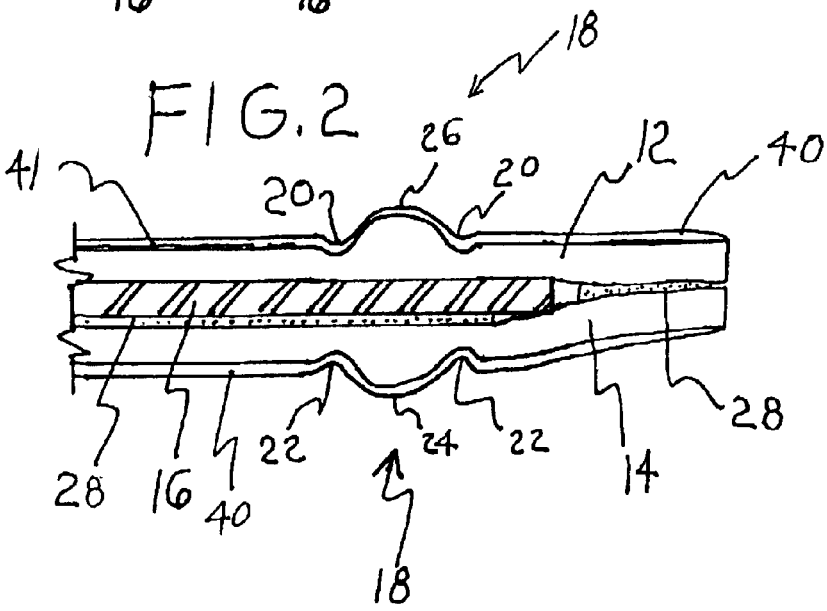
FIG. 2 is a cross-section along the line 2—2 in FIG. 1 showing a joint of the display according to the present invention.

Referring to FIGS. 1 and 2, an articulated display 10 has a front or first substrate 12 attached or layered on a second or back substrate 14. The substrates 12, 14 are preferably made from a generally rigid or stiff material such as cardboard, foam board such as FOMECORE™, PVC board such as SINTRA™, corrugated boards, tag stock boards or chipboard. Alternatively, the generally rigid substrates 12, 14 can be made of any material that is rigid enough to remain generally planar when held on its edges (when standing upright) yet yields when force is applied to bend the substrates—preferably when bent by hand. It will also be appreciated that the two substrates 12, 14 do not need to be of the same type of material although the display parameters (e.g. to display the same thing on both the back and front of the display or adhesive liquid to attach the substrates to each other) may require it.

The display 10 also has generally flat, plastically bendable reinforcing plates 16 disposed to cross joints 18 on the display. The reinforcing plates 16 enable the substrates 12, 14 to be bent at the joints into a bent configuration (see FIG. 4) due to the plastic or malleable character of the reinforcing plates. The reinforcing plates 16 then hold the substrates 12, 14 in this bent configuration. Again, due to the plastic or malleable character of the reinforcing plates 16, the substrates can then be bent back to a generally flat configuration (e.g. where all sections of the substrate generally lie in the same plane as shown in FIG. 1).

The reinforcing plate 16 is preferably made of metals such as copper, tin, aluminum, low carbon steel or an alloy thereof. Steel may be used when magnetic effects are desired. In one example, where the substrates 12, 14 are ⅛ inch foam boards, the reinforcing plates 16 are preferably made of 0.010 inch thick aluminum. The thickness and width (cross-sectioned area) of the plates are selected as a function of the mass of the parts that they articulate and the desired stiffness of the joint. Thus, it will also be appreciated that generally flat metal wire arrays or meshes may be used instead of a solid plate.

Referring to FIG. 2, a typical joint area is shown. Here each substrate 12, 14 has its own joint 18. The joint 18 on substrate 12 has two linear indents 20 on either side of a linear raised portion 26. Likewise, the joint 18 on substrate 14 has two linear indents 22 on either side of a linear raised portion 24. In the preferred embodiment, the joints 18 directly correspond to or oppose each other so that indents 20 oppose indents 22 and raised portion 24 opposes raised portion 26 as shown in FIG. 2.

With this joint configuration, when the reinforcing plate 16 is bent at the joints 18, the substrates will fold at the joints. The indents 20, 22 and raised portions 24, 26 generally maintain the folds or fold lines on the substrate 12 or 14 within the joint area and more preferably generally at the indents.

As shown in FIG. 2, the substrates 12, 14 adhere to each other and the plate 16 by the use of an adhesive 28 such as Dextrine glue when foam board (FOAMCORE™) is used and resin glue when SINTRA™ is used. It will be appreciated that other adhesives would also be adequate as long as they maintain adequate adherence between paper boards and metal plates and/or between the boards themselves.

Referring to FIG. 1, it will also be appreciated that the display 10 may have a different number of joints 18 than the number of reinforcing plates 16. Thus, a reinforcing plate 16 may not be at every joint 18 on the display 10 when there is more than one joint. It will also be appreciated that a single reinforcing plate 16 may cross more than one joint 18 as shown on the arm 44.

Figure 3:
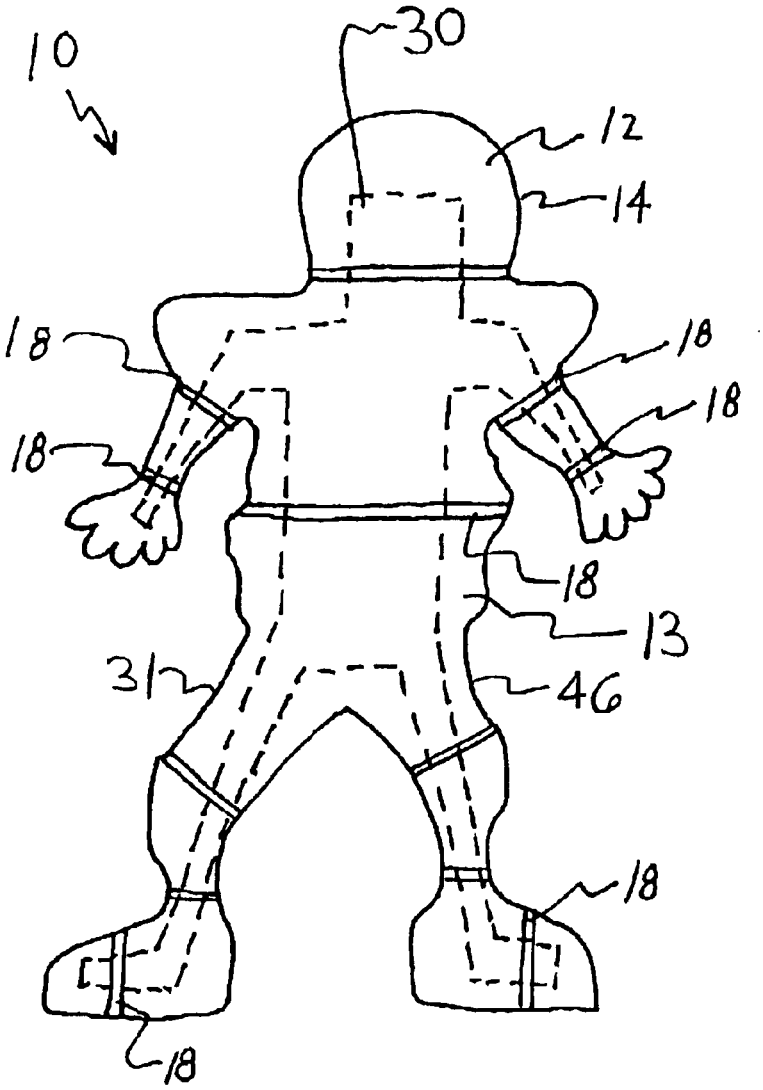
FIG. 3 is a front elevation of an alternative display according to the present invention.
Figure 3A:
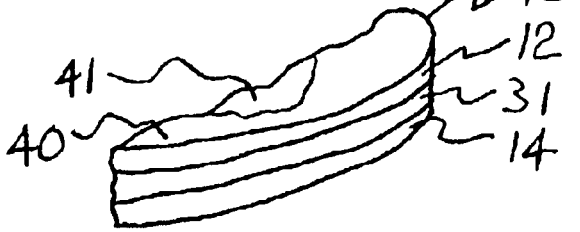
FIG. 3A is a partial edge perspective view of the display of FIG. 3.

Referring to FIGS. 3 and 3A, a full size reinforcing plate may cross all of the joints 18 on the display 10. For this purpose, a sheet of metal 30 (shown in dash) is used that is configured to cross all of the joints 18, or in the alternative, a metal plate 31 (best viewed in FIG. 3A) may be used that has a similar outer edge or silhouette to the outer edge 46 of the substrates 12, 14. This may save labor costs by having the three layer structure or material supplied as one piece, and then stamp-cutting the structure with a desired object silhouette 46.

Figure 4:
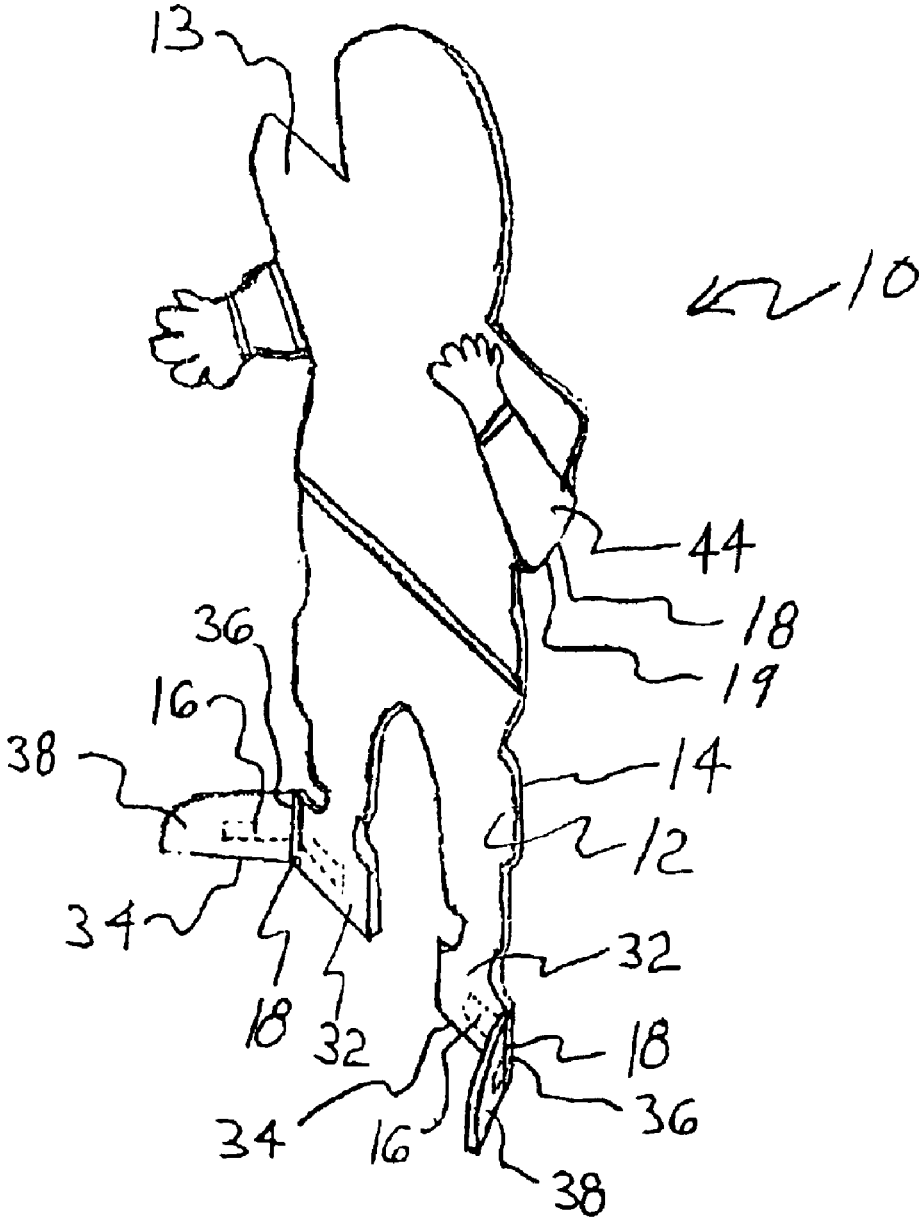
FIG. 4 is a perspective view showing the display in an upright position according to the present invention.

Referring to FIG. 4, the display 10 is rendered free standing or standing upright by bending a base portion 32 of the display 10. This base portion 32 is an integrally formed portion of at least one of the substrates 12, 14, and preferably base portions 32 of both substrates are used. Thus, each substrate 12, 14 is manufactured as a single continuous piece including the base portion 32. The base portion 32 has a bottom edge 34 and a generally vertically extending base joint 36 extending upward from the bottom edge and through the base portion 32. Bending the substrate 12, 14 at the base portion 32 creates a bent portion 38 that braces the display in the standing position shown in FIG. 4. With this configuration, the display 10 stands upright without additional structure being necessary. It will be appreciated that even though two bent portions 38 are shown, the display will stand upright as long as at least one or more bent portions are used. Despite this feature, however, it will also be appreciated that the display 10 may have separate independent or integral support pieces or braces to render the display standing upright.

In one aspect of the invention, the substrates 12 and 14 are provided in any shape or silhouette that is required to relate a certain message or represent a certain object 13. This can be for advertising or other purposes. For instance, a sporting goods store may have display 10 in the shape or silhouette of an object 13 such as a football player as shown in FIGS. 1, 3–4.

Figure 5:
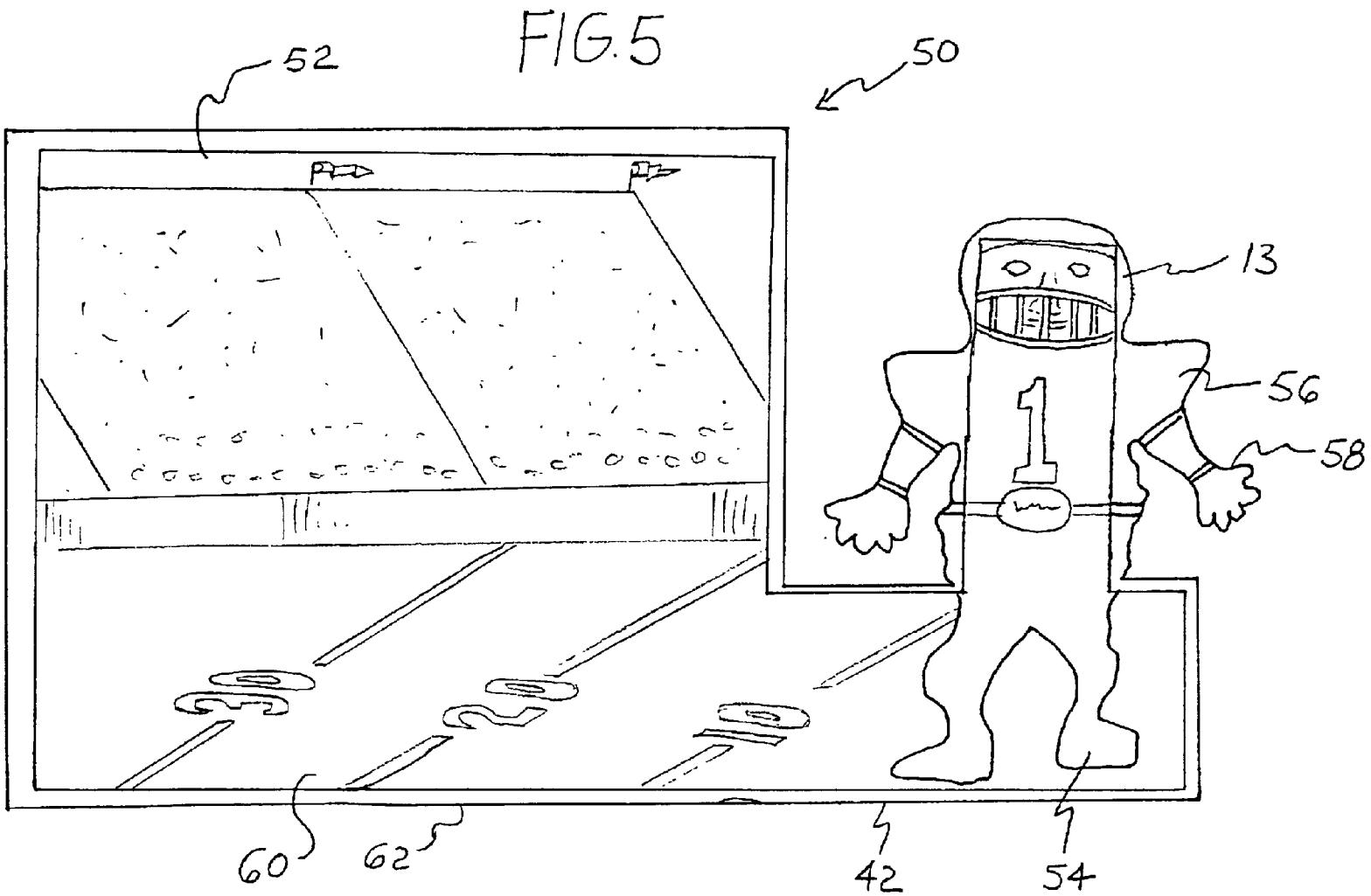
FIG. 5 is a front elevation of another alternative display according to the present invention.

Referring to FIG. 5, the display, of the invention is not limited to any one configuration for representing or conveying a message, information or an object. In one alternative, a display 50 has an image including a picture or scene 52 that has a portion representing the object 13 (the football player). The object 13 is represented by a picture portion 54 and a cut-out portion 56. The outer edge 42 of the display 50 is not cut to match the shape of the object 13 at the picture portion 54. Only the cut-out portion 56 has a silhouette outer edge 58. The picture 52 can be mounted on a one-piece substrate 60 or matching substrates 60, 62 that includes the cut-out portion 56. Thus, the cut-out portion(s) 56 are integrally formed with the remainder of the substrate(s) 60, 62).

Figure 6:
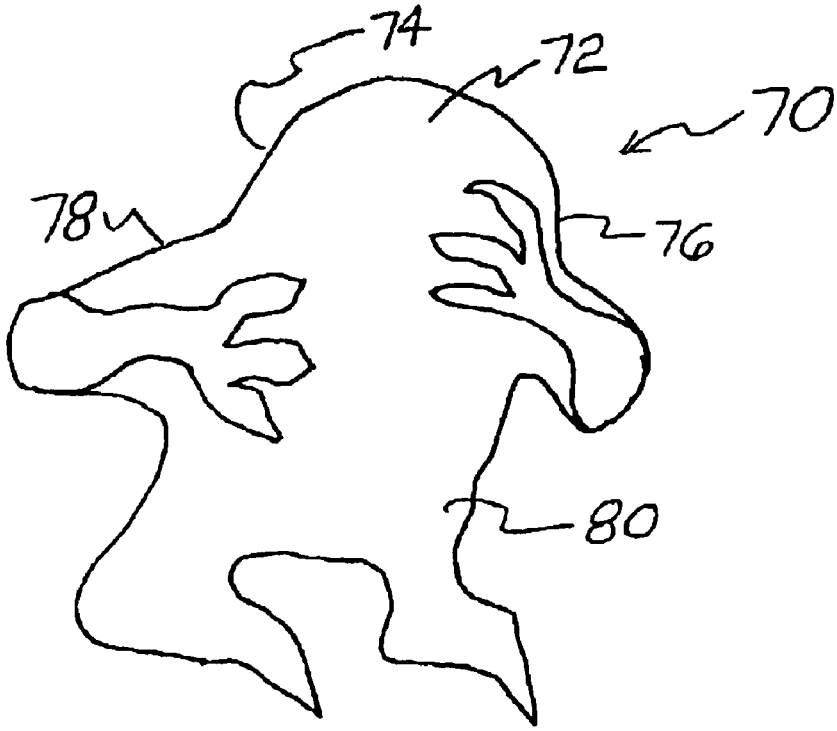
FIG. 6 is a front elevation of yet another alternative display according to the present invention.
Figure 6A:
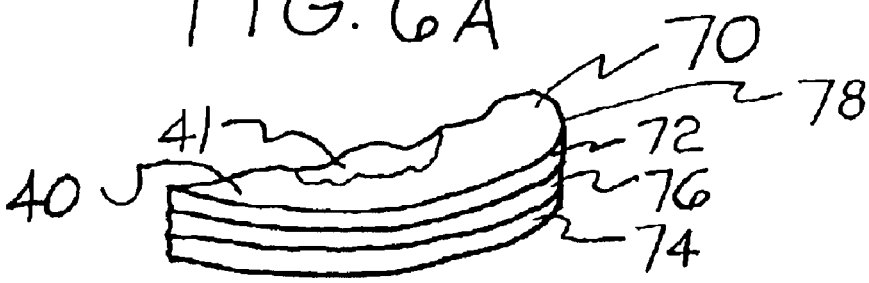
FIG. 6A is a partial edge perspective view of the display of FIG. 6.

Referring to FIGS. 6–6A, an alternative display 70 as shown in FIGS. 3–3A has a full sheet or plate 76 placed between substrates 72, 74 so that all three layers have a matching edge or silhouette 78. In this case, however, no joints 18 are used. The full plate 76 substantially covers the area of the substrates, or at least a majority of it, so that the substrates can be bent anywhere on its surface, and that bend can be maintained.

As with displays 10 and 30, an object 80, which can be anything depictable, may be depicted so that bending the display 70 creates a page for the object. Display 70 may be freestanding or require further supports. One particular configuration uses an 0.010 inch thick plate of tin as plate 76 and 0.0001 to 0.0005 inch thick tag stock on approximately ⅛ to 1/32 inch SINTRA™ for substrates 72, 74.

In other embodiments, at least a portion of the display 10, 30 or 50 depicts or represents an object that moves using jointed limbs. This would include humans, animals, robots, any other moving being and moving machine that can be said to have a joint or appear to have a joint. Referring again to FIG. 4, the substrates 12 and 14 preferably have joints 18 that represent the joints 19 of the object 13. This permits the substrates 12, 14 to form bent configurations so that the display can represent possible poses of the represented object 13. For example, when the object 13 is a football player, it is possible to bend the display to show the football player has bent his arm 44 (see FIG. 4). Many other poses and configurations are possible. In addition, if the object 13 is a human or an animal, the base portion 32 preferably represents a foot, shoe or end of a leg as shown in FIG. 4. It will also be appreciated that display 70 can depict and pose objects with jointed limbs even though it does not have indents for those limbs.

It will also be appreciated, however, that any object can be depicted and still fall within the scope of the invention. Thus, the object could be things without joints including inanimate stationary objects, scenes, designs, abstracts or other objects that do not move.

Referring again to FIG. 1, in another aspect of the present invention, a film or layer 40 of a laminate (also referred to as the third substrate) is disposed on at least one of the substrates 12, 14, and preferably on both when it is desired to display the back as well as the front of the display 10. Also in the preferred embodiment, the laminate 40 lies on the entire substrate 12, 14 including over the joints 18. When a picture 41 (FIG. 2) is printed on one of the substrates 12, 14, or a lithograph is mounted on one of the substrates, covering the deposited or printed film 41 with laminate 40 prevents cracks and pealing of the picture or lithograph anywhere on the surface of the substrates including at the joints 18 so that the picture or lithograph appears substantially continuous. It will be appreciated that more than one laminate substrate or layer 40 can be used on either substrate 12, 14 or both.

In the preferred embodiment, a polypropylene laminate 40 is used which not only protects the image, print or litho on the substrate, but also provides an erasable surface that can be written upon with marker. Thus, images including pictures or text or both to convey information can also be disposed on the exterior of the laminate 40. It will be appreciated that a thin vinyl could be used instead of polypropylene.

In order to construct the display, linear indents 20, 22 are placed on the substrate(s) 12, 14 where the joints 18 are to be located. The first substrate 12 is laid horizontal, and the formed or cut reinforcing plates 16 are positioned on the substrate 12. The adhesive 28 is then applied at least to the substrate 12 and exposed surfaces of the reinforcing plates 16. The second substrate 14 is laid on top of the first substrate 12 and the exposed surface of the reinforcing plates 16. As an alternative, glue is applied to both substrates 12, 14 before constructing the three layer lamination or display 10. A picture may be reproduced on one of the substrates or both, before the substrates are laminated. Alternatively, an image may be printed directly onto a vinyl, or similarly "stretchable" material, which would then be glue-mounted to one or both substrates. If the display 10 includes a representation of an object 13, the outer edge 46 of the substrates 12, 14 are cut to match a silhouette of the object 13 before the process for attaching the two substrates commences. This process allows for relatively inexpensive mass production.

Another method for constructing the display would be to laminate the two substrates 12, 14 with a full sheet of the plastically bendable plate 31 in between (as disclosed for FIGS. 3 and 3A). This allows for a silhouette of the object 13 to be die cut "cookie-cutter" style from a single large sheet of 3-layer lamination. These individual forms or objects 13 will then have die-cut edges 46, and score-cut or indented "joint" lines 18 where bending is desired. The bendable plate 31 is present throughout the entire area of the object 13. This provides additional strength and support. It also allows for "nesting" the objects 13 for better sheet yield while eliminating the hand labor of placing the bendable plate 31 only at specific areas of display 10 or object 13.

Once the display 10 is manufactured in its flat configuration, the display 10 can easily and efficiently be stored and/or transported to stores for display. At the stores, the display 10 is folded along the joints 18 with the reinforcing plates 16 to a desired pose or bent configuration. When display is no longer desired, the joints 18 are bent back so that the substrate(s) 12, 14 lay in a generally flat configuration for storage and/or transport. This process can be repeated multiple times.

Since the manufacturer of the display 10 merely needs to produce a "knocked down" configuration (i.e. the generally flat configuration without any executed bends), the display 10 is then shipped to stores in this flat configuration, where it can be stored until ready for use. This is extremely cost effective since the expense for assembly at the manufacturer level and extra space requirements for transportation and storage of a setup display is eliminated.

The advantages of the present articulated display are now apparent. The articulated display 10 has generally flat, plastically bendable reinforcing plates 16 crossing joints 18 of substrates 12, 14. The reinforcing plates 16 permit the substrates 12, 14 to be bent into a bent configuration, hold the bent configuration, and then permit the substrate to be bent generally flat again for storage or transport. This prevents damage to the display 10, saves storage and transportation space, allows for easy reuse of the display and permits the display to represent an object 13 in a variety of poses.

While various embodiments of the present invention have been described, it should be understood that other modifications and alternatives can be made without departing from the spirit and scope of the invention, which should be determined from the appended claims.

I claim:

1. An articulated display, comprising:

at least two substrates including a first substrate attached to a second substrate, said first substrate having joints opposing and corresponding to joints on at least said second substrate; and at least one plastically bendable, generally flat, reinforcing plate disposed to cross at least one said joint and disposed between said first and second substrates, wherein a single said reinforcing plate crosses more than one joint.

2. The display of claim 1, further comprising at least a third or more substrates mounted on either said first or second substrate or respectively on both.

3. The display of claim 2, wherein said third or more substrates are laminate films.

4. The display of claim 1, wherein said plate is made from at least one material selected from the group containing: copper, aluminum, aluminum alloy, tin and steel.

5. The display of claim 1, wherein at least one of said substrates is a single continuous piece and includes an integrally formed base portion defining a bottom edge and a base joint extending upward from said bottom edge and extending in said base portion, said base joint being disposed so that bending said substrate at said base joint defines a bent portion of said base that permits said bent portion to brace said display in a standing position.

6. The display of claim 1, further comprising at least one image printed upon at least one of said substrates.

7. The display of claim 6, further comprising at least one layer of laminate placed over at least said one substrate for protecting said image.

8. The display of claim 1, further comprising at least one layer of a stretchable material mounted on at least one of said substrates, and an image printed on said stretchable material.

9. The display of claim 8, wherein said material is vinyl.

10. The display of claim 1, wherein said display includes a representation of an articulated object and said joints on said substrates represent joints of said object, wherein said substrates are bent at said joints into a bent configuration for representing a pose of said object.

11. The display of claim 10, wherein said substrates have an outer edge that represent a silhouette of said object.

12. The display of claim 10, wherein an image relating to said object is printed on at least one of said substrates.

13. The display of claim 10, wherein said object is an object that moves using jointed limbs and at least one of said joints is disposed to represent at least one joint of said object selected from the group containing a neck, shoulder, elbow, wrist, waist, knee and ankle.

14. The display of claim 10, wherein said object is one selected from the group containing a scene, design, inanimate object, and stationary object.

15. The display of claim 1, wherein at least one joint includes an elongated raised portion between two elongated indents, and wherein bending said substrate at said one joint limits a fold in said substrate to generally stay at said joint by remaining along said indents.

16. The display of claim 1, wherein said single plate crosses over every joint on the display.

17. The display of claim 1, wherein at least one of said substrates is a single continuous piece and includes an integrally formed base portion defining a bottom edge being adhered to said plate(s), said bottom edge being bendable for forming a bent portion of said base that permits said bent portion to brace said display in a standing position.

18. An articulated display including a representation of an articulated object, comprising:

at least one substantially flat substrate having joints disposed at positions corresponding to and representing joints of the object; and at least one plastically bendable reinforcing plate disposed across at least one of said joints for holding said substrate in a bent configuration for representing a pose by the objects, wherein a single said reinforcing plate crosses more than one joint.

19. The display of claim 18, wherein said plate is made from at least one material selected from the group containing: aluminum, steel, tin and an alloy thereof.

20. The display of claim 18, wherein the object is a human and at least one of said joints is disposed to represent at least one joint of the object selected from the group containing a neck, shoulder, elbow, wrist, waist, knee and ankle.

21. The display of claim 18, wherein the display stands upright by itself.

22. The display of claim 21, wherein said substrate is a single continuous piece and includes an integrally formed base portion defining a bottom edge and a base joint extending upward from said bottom edge and extending in said base portion, said base joint being disposed so that bending said substrate and said plate at said base joint defines a bent portion of said base portion that permits said bent portion to brace said display in a standing position.

23. The display of claim 22, wherein said base portion represents a foot, shoe or end of a leg.

24. The display of claim 18, wherein said substrate is a first substrate, the display further comprising a second substrate, said reinforcing plate(s) being sandwiched between said first and second substrates, said joint(s) on said first substrate opposing and corresponding to joint(s) on said second substrate.

25. The display of claim 18, wherein said substrate has an image of said object printed upon said substrate, the display further comprising a laminate placed over said substrate for protecting said picture.

26. The display of claim 18, wherein at least one said joint includes an elongated raised portion between two elongated indents, and wherein bending said substrate at said one joint limits a fold in said substrate to generally stay at said joint by generally remaining along said indents.

27. The display of claim 26, wherein said substrate is a first substrate, the display further comprising a second substrate, said reinforcing plate(s) being sandwiched between said first and second substrates, said joints on said second substrate having indents and a raised portion opposing said indents and said raised portion on said joints of said first substrate, wherein said raised portions of said first and second substrates extend in opposite directions.

28. The display of claim 18, wherein said single reinforcing plate crosses over every joint on the display.

29. An articulated display, comprising:

a generally rigid substrate, said substrate having indents defining joints for bending said substrate at said joints; and a flat, plastically bendable, reinforcing plate attached to said substrate and disposed to cross at least one said joint, wherein said substrate is configured for bending at least at said one joint to hold a bent configuration.

30. The display of claim 29, wherein a said reinforcing plate is disposed at every said joint on said substrate.

31. The display of claim 29, wherein said substrate is a first substrate, the display comprising a second substrate layered on said first substrate, said plate(s) being disposed between the first and second substrates.

32. An articulated display representing an articulated object, comprising:

a generally rigid substrate having joints disposed at positions corresponding to joints of the object;

a plastically bendable reinforcing plate disposed across at least one said joint for holding said substrate in a bent configuration and making it appear as though the object is making a corresponding pose, said substrate being a single continuous piece and includes an integrally formed base portion defining a bottom edge and a base joint extending upward from said bottom edge and extending in said base portion, said base joint being disposed so that bending said substrate at said base joint defines a bent portion of said base that permits said bent portion to brace said display in a standing position.

33. The display of claim 32, where said substrate is a first substrate, the display further comprising a second generally rigid substrate layered upon said first substrate, said reinforcing plate(s) being disposed between said first and second substrates.

34. A bendable display, comprising:

at least one plastically bendable, generally flat, reinforcing plate; and at least two substrates including a first substrate and a second substrate sandwiching said plate(s) between said substrates, said plate(s) adhering to at least one of said substrates, wherein the display can be plastically bent anywhere said plate(s) abut at least one of said substrates, and wherein said substrates and said plate(s) can be bent so that said display is free standing.

35. The display of claim 34, further comprising a third or more substrates mounted on said first, second or respectively on both substrates.

36. The display of claim 34, wherein the display includes a representation of an object, and wherein the display is bendable for maintaining a pose of said object.

37. The display of claim 36, wherein said substrates have an outer edge that represent a silhouette of said object.

38. The display of claim 37, wherein said plate(s) has a periphery that matches said silhouette of said object.

39. The display of claim 36, wherein an image relating to said object is printed on at least one of said substrates.

40. The display of claim 34, wherein at least one of said substrates has an image printed upon said substrate(s).

41. The display of claim 40, further comprising at least one layer of a laminate placed over said substrate(s) for protecting said image(s).

42. The display of claim 34, further comprising at least one layer of stretchable material mounted on at least one of said substrates, and an image printed on said stretchable material.

43. The display of claim 42, wherein said material is vinyl.

44. The display of claim 34, wherein said plate(s) is made from at least one material selected from the group containing: copper, aluminum, tin, steel and an alloy thereof.

45. The display of claim 34, wherein said plate(s) adheres to both said substrates.

46. The display of claim 34, further comprising a single continuous plate abutting substantially the entire area of said substrates.

47. The display of claim 46, wherein the display represents an object, and wherein said single plate and said substrates have matching outer peripheries that form a silhouette of said object.

48. The display of claim 34, wherein said substrates and plate(s) are configured for bending to a bent configuration, maintaining said bent configuration and for then subsequently being bent back to a flat configuration repeatedly.

49. An articulated display, comprising:

at least two substrates including a first substrate attached to a second substrate, said first substrate having joints opposing and corresponding to joints on at least said second substrate; and at least one plastically bendable, generally flat, reinforcing plate disposed to cross at least one said joint and disposed between said first and second substrates, wherein at least one of said substrates is a single continuous piece and includes an integrally formed base portion defining a bottom edge and a base joint extending upward from said bottom edge and extending in said base portion, said base joint being disposed so that bending said substrate at said base joint defines a bent portion of said base that permits said bent portion to brace said display in a standing position.

50. An articulated display, comprising:

at least two substrates including a first substrate attached to a second substrate, said first substrate having joints opposing and corresponding to joints on at least said second substrate;

at least one plastically bendable, generally flat, reinforcing plate disposed to cross at least one said joint and disposed between said first and second substrates;

at least one layer of a stretchable material mounted on at least one of said substrates; and an image printed on said stretchable material.

51. An articulated display, comprising:

at least two substrates including a first substrate attached to a second substrate, said first substrate having joints opposing and corresponding to joints on at least said second substrate; and at least one plastically bendable, generally flat, reinforcing plate disposed to cross at least one said joint and disposed between said first and second substrates, wherein at least one joint includes an elongated raised portion between two elongated indents, and wherein bending said substrate at said one joint limits a fold in said substrate to generally stay at said joint by remaining along said indents.

52. An articulated display including a representation of an articulated object, comprising:

at least one substantially flat substrate having joints disposed at positions corresponding to and representing joints of the object; and at least one plastically bendable reinforcing plate disposed across at least one of said joints for holding said substrate in a bent configuration for representing a pose by the object, wherein said substrate is a single continuous piece and includes an integrally formed base portion defining a bottom edge and a base joint extending upward from said bottom edge and extending in said base portion, said base joint being disposed so that bending said substrate and said plate at said base joint defines a bent portion of said base portion that permits said bent portion to brace said display in a standing position.

53. An articulated display including a representation of an articulated object, comprising:

at least one substantially flat substrate having joints disposed at positions corresponding to and representing joints of the object; and at least one plastically bendable reinforcing plate disposed across at least one of said joints for holding said substrate in a bent configuration for representing a pose by the object, wherein at least one said joint includes an elongated raised portion between two elongated indents, and wherein bending said substrate at said one joint limits a fold in said substrate to generally stay at said joint by generally remaining along said indents.

54. A bendable display, comprising:

at least one plastically bendable, generally flat, reinforcing plate; and at least two substrates including a first substrate and a second substrate sandwiching said plate(s) between said substrates, said plate(s) adhering to at least one of said substrates, wherein the display can be plastically bent anywhere said plate(s) abut at least one of said substrates;

at least one layer of stretchable material mounted on at least one of said substrates; and an image printed on said stretchable material.

* * * * *